United States Patent [19]

de Vries

[11] 4,003,149

[45] Jan. 18, 1977

[54] DISPLAY DEVICE AND DISPLAY UNIT FOR USE THEREIN

[76] Inventor: Peter de Vries, R.R. No. 1, Lachute, Quebec, Canada

[22] Filed: Nov. 26, 1974

[21] Appl. No.: 527,270

[52] U.S. Cl. ..... 40/28 C; 40/37

[51] Int. Cl.[2] ..... G09F 9/30; G09F 13/34

[58] Field of Search ..... 40/28 C, 28 R, 28 A, 40/28 B, 28 D, 218, 37, 106.21, 106.22, 130 E, 106.54; 340/378 R, 380 R, 324 R; 116/65, 114 H, DIG. 7; 58/42; 221/278, 279

[56] References Cited

UNITED STATES PATENTS

| | | | |
|---|---|---|---|
| 3,530,606 | 9/1970 | O'Keefe | 40/28 C |
| 3,748,764 | 7/1973 | Schilter | 40/37 |

*Primary Examiner*—John F. Pitrelli

[57] ABSTRACT

A display device consists of rows and columns of display units each capable of either an illuminated or a dark condition whereby selection of suitable units for illumination can form a display character. The character can be caused to progress along the device by connecting the units in two groups of alternate units and by energizing these groups alternately to cause each unit momentarily to assume a master relationship towards the next downstream unit and hence transfers its state of illumination to such downstream unit. Energization is pneumatic, each unit containing a shutter that acts, when moved between two positions, both to change the state of such unit and as a valve controlling air flow to the next downstream unit.

18 Claims, 15 Drawing Figures

DISPLAY DEVICE AND DISPLAY UNIT FOR USE THEREIN

This invention relates to a display device in which characters such as letters or numerals can be formed from rows and columns of display units, each of which can be brought to either one of two different conditions, i.e. an ON or OFF condition, e.g. illuminated or dark. The invention also relates to the display units themselves.

An object of a preferred form of the present invention is to provide a device in which light is allowed either to pass through or not to pass through the respective display units, whereby to form desired patterns of light and hence generate the characters. An alternative construction of unit involves the reflection of light, instead of its transmission, when in the illuminated condition.

Another object of a preferred embodiment of the present invention is to provide a display device that is "dynamic", in the sense that a character that has been formed by means of a selected array of illuminated units can be caused to progress along the device by similar energization of adjacent units. In this way, a letter, word or sentence can be caused to travel along the device from one end to the other.

Further features and aspects of the present invention will be apparent from the embodiments thereof that are illustrated by way of example in the accompanying drawings. The broad scope of the invention is, however, not limited to the details of these embodiments, but is defined in the appended claims.

DETAILED DESCRIPTION OF SPECIFIC EMBODIMENTS

Figure 1:
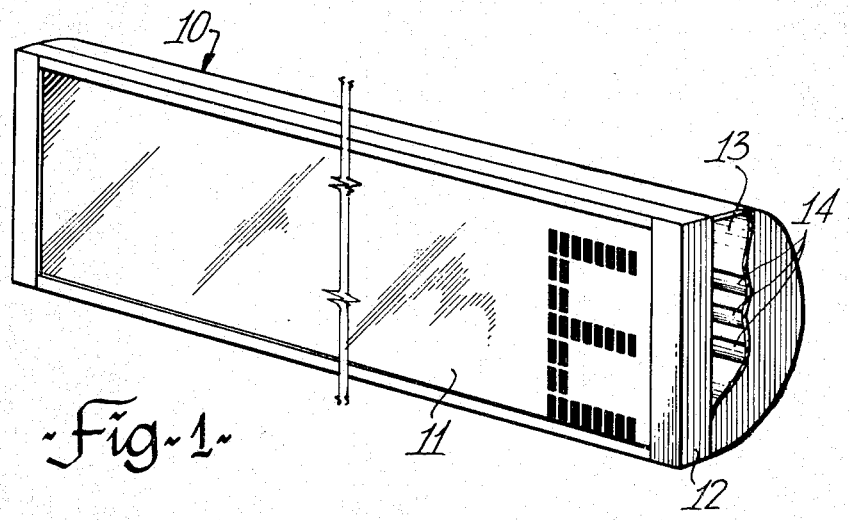
FIG. 1 is a front perspective, partly cut away view of a display device.

As shown in FIG. 1, the display device 10 consists of a transparent front sheet 11, typically of glass or an acrylic plastic, supported in a frame 12 behind which there is located a reflector 13 and suitable light sources 14 such as luminescent tubes. As FIG. 2 demonstrates, the frame 12 sandwiches the display units between the front transparent sheet 11 and a similar rear transparent sheet 15.

FIG. 1 shows how the letter E can be formed by allowing light from the source 14 to be transmitted through a selected group of units arranged in the necessary pattern to form the character desired. In FIG. 1, it is assumed that all the other units that extend along the device in seven horizontal rows arranged vertically one above the other are "closed" in the sense that they do not permit light to be transmitted through them. Only the units forming the E transmit light. Of course, the reverse arrangement could be used with the characters formed as "black on white", i.e. with closed units contrasting with a background of illumination. It is however preferred to form the characters as illuminated shapes on a dark background, and this mode of operation will be assumed throughout the description below. In addition, natural light, if available, may avoid the need for a source of light.

Figure 7A:
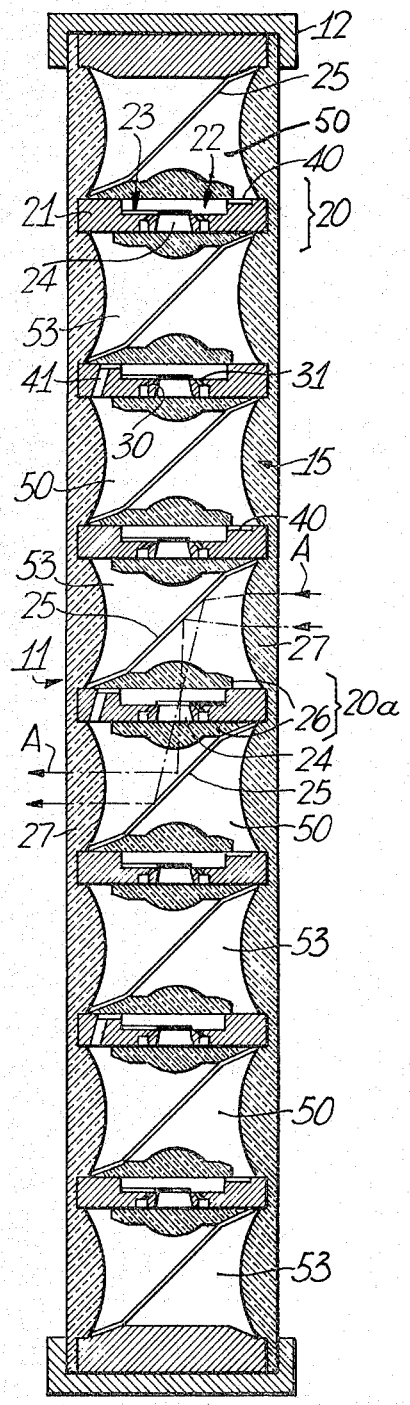
FIG. 7*a* is a vertical section through the device.

With reference first to the upper portion of FIG. 7*a*, a typical display unit, here designated 20, will be seen to be formed in an elongated opaque housing member 21 having a cavity 22 in which a shutter 23 is located. FIG. 3 shows such a shutter 23 on a larger scale and demonstrates that it is formed with an opaque portion 23′ and a transparent or translucent portion 23″. Each shutter 23 can be caused to slide back and forth longitudinally in its cavity 22 between two positions. In the closed position of the unit, the opaque portion 23′ is located centrally of the cavity 22 over an opening 24 (see the upper unit 20 in FIG. 7*a*). Alternatively, when a shutter is in its open position, as shown by the foremost shutter 23 in FIG. 3 or by the shutter of the unit 20*a* in the fourth row of units in FIG. 7*a*, light A from the source 14 emerges from the front plate 11, having been reflected by mirror surfaces 25 and transmitted through transparent lens members 26 as well as convex lens portions 27 formed in the rear and front plates 15 and 11 respectively. As FIGS. 2 and 3 demonstrate, the lens members 26 are elongated, extending for the full length of the device. As will later be demonstrated, these members, which may be formed of glass or acrylic plastic, also serve to isolate the units 20 from each other in terms of air pressure.

Figure 3:
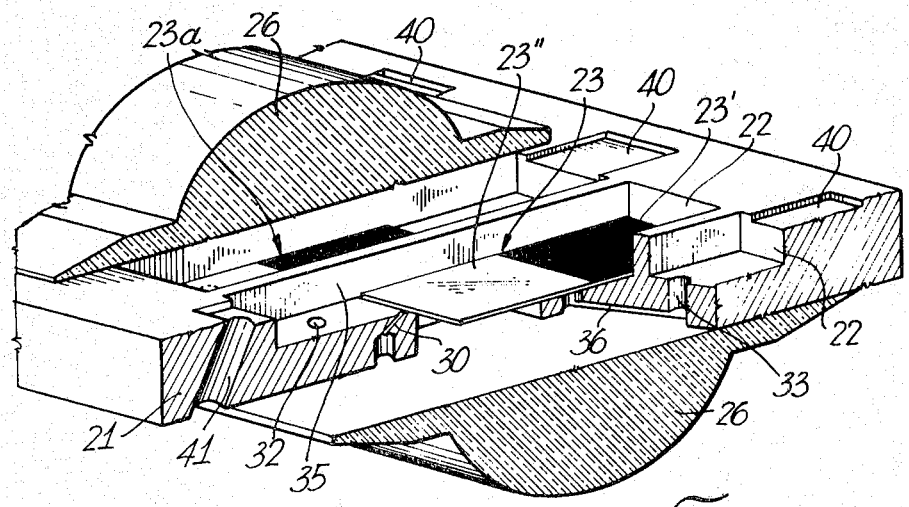
FIG. 3 is a still larger scale, fragmentary, cut away view showing the operating parts of a few adjacent display units of the device of FIGS. 1 and 2.
Figure 4:
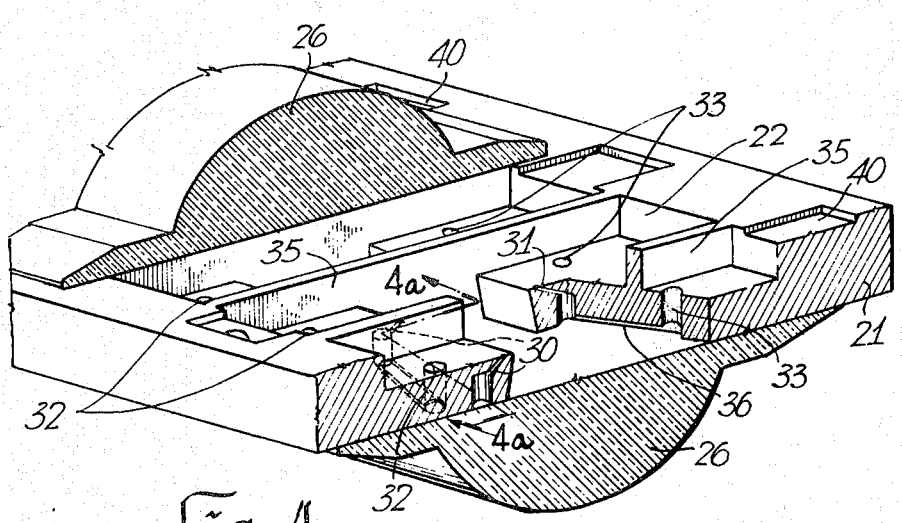
FIG. 4 is a view similar to FIG. 3 illustrating other aspects of this apparatus.

The shutters 23 are pneumatically moved between their closed and open positions by air that is forced through one or other of nozzles 30 and 31. A typical nozzle 30 is best seen in FIG. 3 and a typical nozzle 31, hidden by the shutter 23 in FIG. 3, is best seen in FIG. 4, from which the shutter 23 has been removed for purposes of illustration. Air passed through a nozzle 30 will move its shutter 23 to open position, e.g. to the right in FIG. 3. If the shutter is already in its open position such air will have no effect. Air emerging from a nozzle 31 will have the reverse effect, driving its shutter from right to left in FIG. 3, namely to closed position.

Figure 4A:
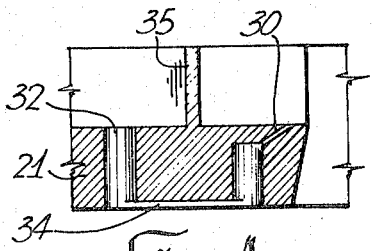
FIG. 4*a* is a section on the line 4*a*—4*a* in FIG. 4.
Figure 5:
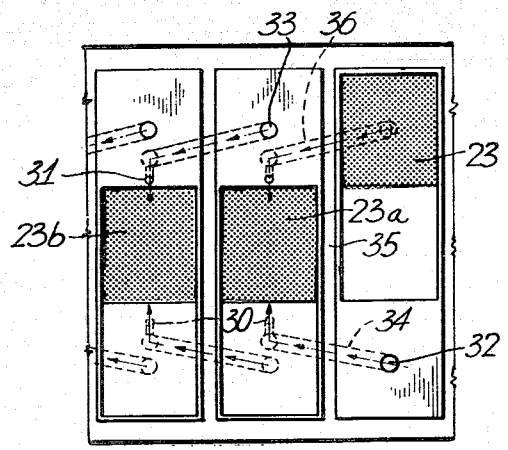
FIG. 5 is a fragmentary plan view of the apparatus of FIGS. 3 and 4.

An important feature of the present apparatus is the manner in which each shutter can be controlled by its upstream neighbour, for which purpose the shutters act not only to transmit or occlude light, but also as valves controlling the air flow. FIGS. 3, 4 and 5 show ports 32 each arranged to be blocked by a shutter when it is closed (shutter 23*a* in FIGS. 3 and 5) and to permit passage of air when the shutter is open (shutter 23 in FIG. 3). Near the other ends of the cavities 22 are ports 33 which, conversely, are open when the shutter is closed and vice versa. The port 32 of one unit connects through a passageway 34 (FIG. 4*a*) to the nozzle 30 of the adjacent downstream unit. In a similar manner each port 33 is connected by a passageway 36 to the nozzle 31 of the next downstream unit. The cavities 22 of the respective units are otherwise isolated from each other by the top and bottom lens members 26 and intermediate walls 35.

As shown in FIG. 3, the units alternate in regard to air supply. Every second unit has a shallow subsidiary cavity 40 that permits air received from a source (later to be described) to enter the main cavity 22. Intermediate units are each supplied by air through a conduit 41 formed in the member 21. These air supply arrangements alternate both in the horizontal direction, as shown in FIG. 3, and also in the vertical direction, as shown in FIG. 7*a*. The horizontal alternation is further demonstrated by a comparison of FIGS. 7*a* and 7*b*, since these sections are taken through adjacent columns of units.

Assuming that the cavity 40 partly shown at the extreme right of FIGS. 3 and 4 is energized with air under pressure, and that the shutter (shown removed) in the main cavity 22 with which this subsidiary cavity 40 communicates, is in its closed position, i.e. to the left, the port 33 will then be open to allow air to pass to the nozzle 31 of the next unit, thus moving the shutter 23 shown in such unit in FIG. 3 from its open to its closed position. In other words, the upstream shutter has become the master with the downstream shutter its slave in the sense of reproducing the condition of the master shutter. Had the master shutter been in its open position, blocking the port 33 and opening the port 32, air would have passed to the associated jet 30 to move the next shutter to its open position, i.e. reproduction in the downstream or slave shutter of the condition of the upstream or master shutter.

When, instead of energising the cavities 40, the conduits 41 are pressurised, essentially the same master-slave relationship is set up, but this time between the second and third units shown in FIG. 3, 4 and 5. For example, the second unit (the one with the shutter 23) is now in its open position. This would allow air to pass through its port 32 to the next downstream nozzle 30 to move the next shutter 23*a* to its open position, again reproducing the condition of the upstream shutter. As FIG. 5 shows the shutter 23*a* can similarly control the next shutter 23*b*.

Figure 6:
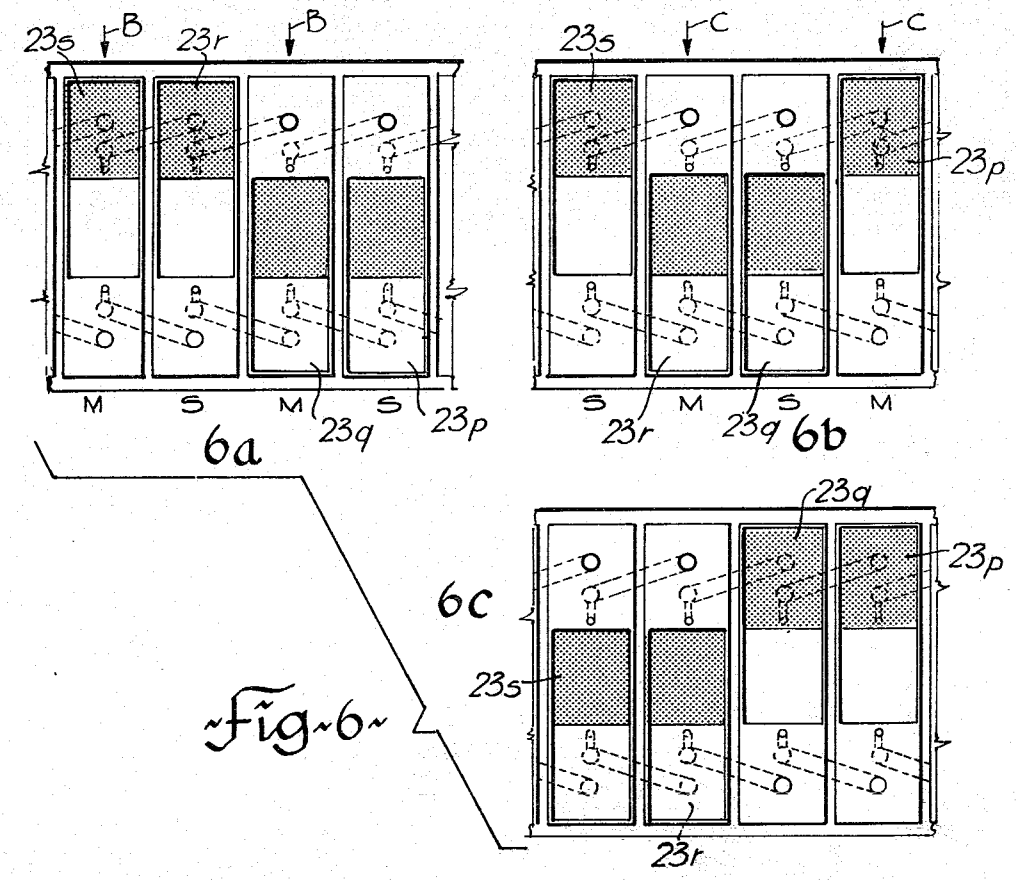
FIG. 6*a* is a view similar to FIG. 5 illustrating a first condition of a group of adjacent units.
FIG. 6*b* is the same as FIG. 6*a* but showing the parts in a different condition.
FIG. 6*c* is the same as FIG. 6*b* but showing the parts in a still different condition.

The overall effect of this arrangement is best demonstrated by the three parts of FIG. 6. FIG. 6*a* shows an initial condition for four adjacent units having closed shutters 23*p*, 23*q*, and open shutters 23*r* and 23*s*. Assume that the even numbered units are energized with pressure air, as demonstrated by the arrows B, causing these units to become the masters M, the intermediate units being slaves S. As a consequence, and as shown by FIG. 6*b*, the condition of the master shutter 23*q* is now transferred to its slave 23*r*, the conditions of shutters 23*q* and 23*s* remaining unchanged since they are now masters. The condition of slave shutter 23*p* is assumed to be changed to reproduce the condition of its upstream master (not shown).

In the next cycle, the odd numbered units are energized with pressure air, as demonstrated by the arrows C, to make these units masters M and the intermediate units slaves S. The result, shown in FIG. 6*c*, is for the slave shutters 23*q* and 23*s* now to adopt the conditions of their respective masters 23*p* and 23*r*, which latter remain unchanged. This alternate energization of odd and even units is continued and it will be observed that the effect is for the condition of an adjacent pair of units to progress continuously along the device. For example, the closed condition of shutters 23*p* and 23*q* in FIG. 6*a* will be seen to be moved one unit at a time along the device from right to left as shown successively by FIG. 6*b* and 6*c*.

In FIGS. 3 to 6, the nozzles 30 and 31 are shown located such that, after each such nozzle has been effective to move the shutter away, the nozzle is no longer covered by the shutter, e.g. in FIG. 3 the nozzle 30 which has moved the shutter 23″ to the right is not covered by such shutter. If it is found that, upon subsequent pressurisation of the cavity in which such shutter is located for control of the next downstream shutter through the port 32, any significant pressure is lost through reverse flow in the nozzle 30, the location of this nozzle (and correspondingly of all the other nozzles) can be moved slightly so that it is just covered by the end of the associated shutter.

A manner in which air can be directed to the units will now be described with initial reference to FIG. 8 which shows a diagrammatic representation of the frame 12 divided into eight longitudinal passageways arranged alternately. The odd numbered passages 50 are connected via a header chamber 51 to a conduit 52, while the even numbered passages 53 are connected via a header chamber 54 to a conduit 55. The conduits 52 and 55 are arranged to communicate with opposite sides of a piston 56 connected to a crank assembly 57 of a motor 58. As the motor 58 turns and the piston 56 reciprocates, the passages 50 and 53 are alternately pressurised.

Figure 2:
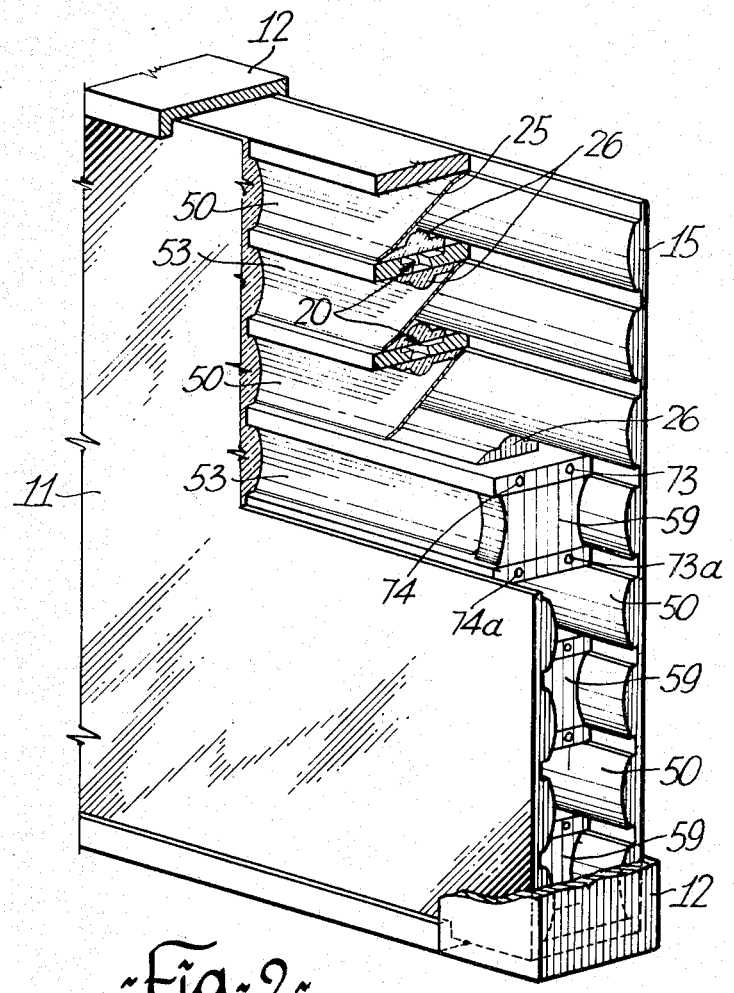
FIG. 2 is a larger scale, also partly cut away view of a fragment of the device of FIG. 1.
Figure 7B:
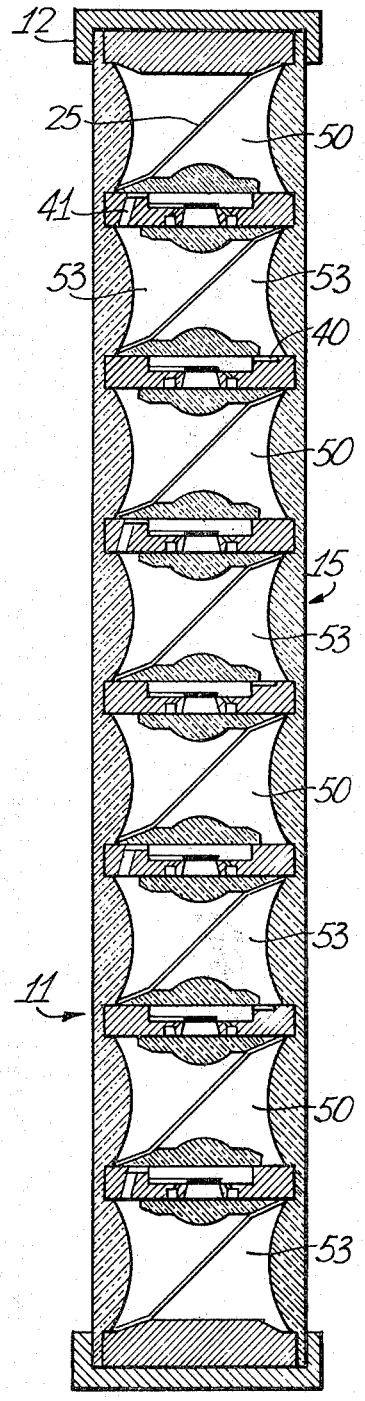
FIG. 7*b* is a further vertical section through the device taken at a location displaced from the section of FIG. 7*a* by one unit.

The passageways 50 and 53 are also shown in FIGS. 2, 7*a* and 7*b* extending along the device. In this connection it should be made clear that the mirrors 25 do not extend fully to the ends of the passageways, so that the two sides of each mirror will be at the same pressure. In other words, the mirrors do not form dividers and can be ignored for purposes of considering the pressures in the passageways 50, 53.

Assuming that the passageways 50 are pressurised, it will be seen that the top unit 20 in FIG. 7*a* will find its air receiving cavity 40 exposed to such pressure. At the same time the unit immediately below the upper unit 20 in FIG. 7*a* will be pressurised through its conduit 41 from the third passageway down, which is one of the passageways 50. This same passageway 50 will also energize the third unit down through its cavity 40 and in fact all the units of this vertical column will be energized when the passageways 50 are pressurized. The column of units horizontally displaced by one location, namely those shown in FIG. 7*b*, will, on the other hand, be energized when the passageways 53 receive pressure air, again through their cavities 40 and conduits 41. Thus alternate pressurisation of the passageways 50, 53 results in alternate energization of odd and even columns or "groups" of units, causing each row of units to function simultaneously in the manner already described in connection with FIG. 6. FIGS. 2 and 8 show blocks 59 which close the ends of the passageways 53. Similar blocks 60 (shown in FIG. 8 only) are located at the other end of the device.

The foregoing description assumes that a character, such as the letter E shown in FIG. 1, has already been written into the device, alternate pressurisation of the two groups of units by the passageways 50 and 53 serving to cause this character to progress from right to left along the device. It will, of course, be necessary to provide input means for introducing the character into the device at its right hand end, and ways in which this result can be achieved will now be described.

Figure 8:
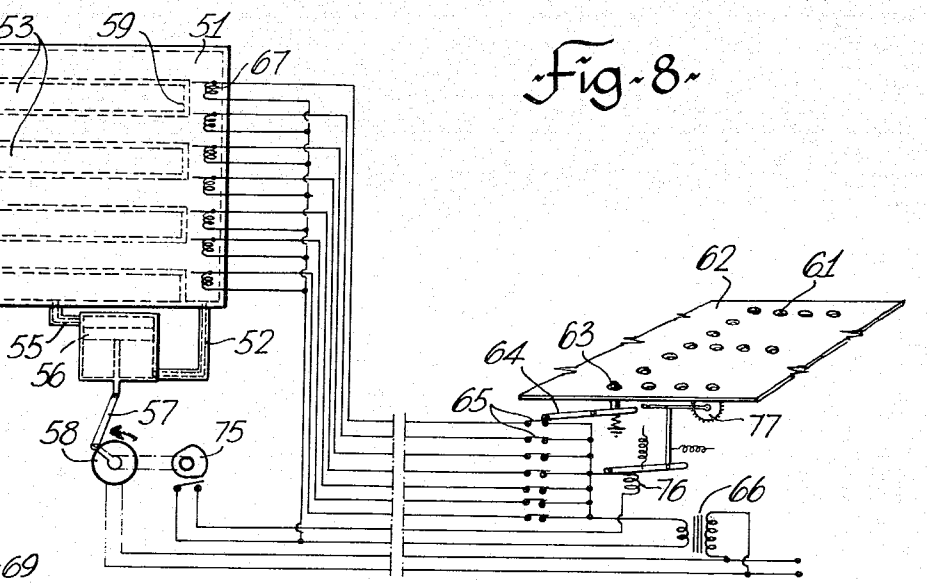
FIG. 8 is a diagrammatic view illustrating a control system.
Figure 9:
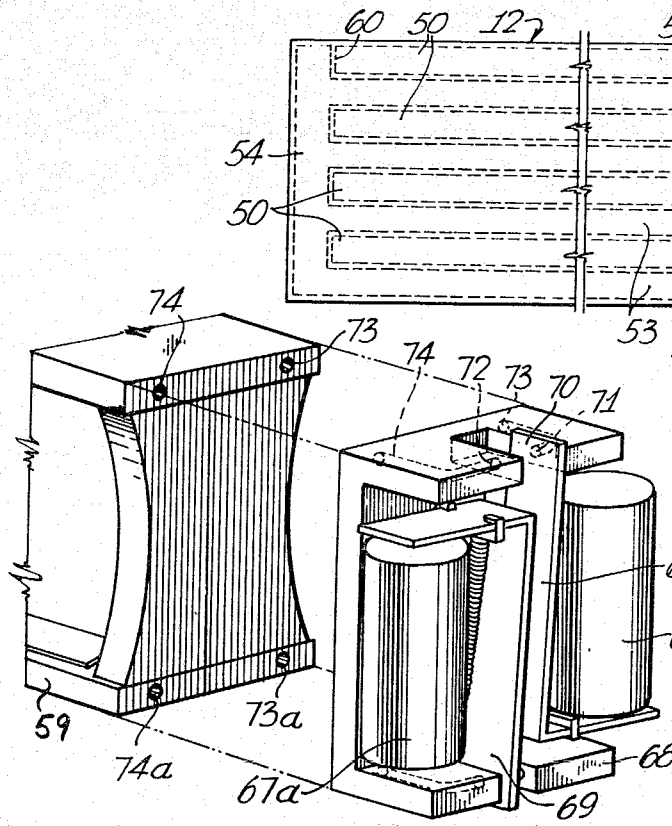
FIG. 9 is a fragmentary view illustrating a pair of control relays and their operation.

FIG. 8 demonstrates one such method. Assume that the character to be entered in the device has been formed as a pattern of holes 61 on a tape 62. A row of seven sensor pins 63 (only one shown in FIG. 8) can move up into each of these holes 61 to cause a row of levers to close respective pairs of contacts 65. The seven pairs of contacts 65 are all shown closed, since there is a full row of seven holes 61 representing the spine of the letter E. Each pair of contacts will connect power from a source 66 to a respective one of control solenoids 67. A typical pair of such solenoids 67, 67*a* is shown in FIG. 9, the two solenoids being mounted on a single mounting 68 for convenience. Each solenoid has a conventional clapper 69, the movable end 70 of which swings between two positions in which it blocks one or other of two openings 71, 72 that communicate respectively with conduits 73, 74 extending through the end blocks 59 (FIGS. 2 and 9). The solenoid 67*a* acts similarly in respect of conduits 73*a* and 74*a*. These solenoids 67 are located in the header chamber 51 (FIG. 8) so as to be exposed to the air pressure fluctuations of this chamber. When it is pressurized the air pressure will pass through either one of conduits 73 or 74, depending on the status of the solenoid, which in turn depends on the status of its corresponding contacts 65. The conduits 73 and 74 of each solenoid lead to the respective nozzles 30 and 31 of respective units of the first or most upstream column of units of the device. These units of the first column, with no upstream units before them, are thus slaves of the solenoids 67 when the passageways 50 are energized.

The motor 58 also operates a cam 75 which energizes a solenoid 76 to cause a spiked wheel 77 to index the tape 62 forward once for each rotation of the crank 57 to align the sensor pins 63 with the next row of holes or absence of holes, as the case may be. This indexing takes place when the passageways 53 are pressurised and the relays 67 are dormant. The mechanism operating the indexing wheel 77 has not been shown in detail, because such a mechanism is described and illustrated in Canadian Patent No. 721,426 of Naxon issued Nov. 9, 1967, the contents of which are incorporated herein by reference.

It will be noted that the character formed on the tape 62, in this case the letter E, provides only one hole to energize two horizontally adjacent units of the display device. For example, the spine of the E, which appears in FIG. 1 as represented by two adjacent columns of units, is only represented by a single row of holes in FIG. 8. This situation arises because energization of the first column of units only takes place on alternate cycles, that is during pressurisation of the passageways 50. During the intermediate cycles, that is during pressurisation of the passageways 53, there is no input to the first column of units which remain as they were. Such first column now functions as a column of master units, transmitting their conditions to the slave units of the second column. During this time the tape 62 is indexed forward as mentioned. When the passageways 50 are again pressurised, the second row of information on the tape 62 is fed into the first column of units and the information in the second column of units is transferred to the third column, since the second column units now become masters to the slaves of the third column. Thus the initial row of information, the spine of the E, now appears in both the second and third columns. In this way the information contained in each single row of holes of the tape is reproduced as two columns of units. Indeed no information can ever be represented by less than two adjacent columns in view of the particular alternate master-slave relationship set up in this apparatus.

Figure 10:
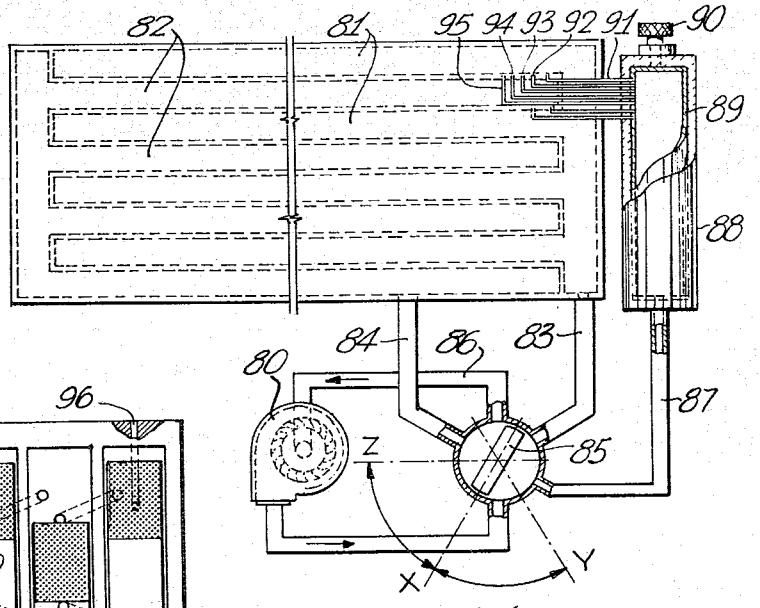
FIG. 10 is a diagrammatic view of an alternative method of control of the device.

If preferred, instead of inserting the information column by column and then advancing it, it is possible to insert a whole character at a time. Such a system is illustrated in FIG. 10, which shows a blower 80 supplying pressure air through conduits 83 and 84 to passageways 81 and 82 that correspond generally to the passageways 50 and 53 respectively. Whichever of the conduits 83, 84 receives pressure depends upon the position of a valve vane 85 which in FIG. 10 is shown in position X which pressurises conduit 83, while connecting conduit 84 to exhaust 86. When moved to position Y, the vane 85 reverses this situation. Oscillation of the vane between positions X and Y thus performs essentially the same function as reciprocation of the piston 56 in FIG. 8, and serves to cause characters to travel along the device.

For initial entry of a character, the vane 85 is moved to a position Z in which neither conduit 83 or 84 is pressurized. Instead a conduit 87 conveys the air to a housing 88 in which a programming drum 89 is rotatable. This drum 89 will have a number of discrete positions, for example 50: 26 for letters and the remainder for numbers and other symbols. Based on the present arrangement of seven rows of units (which is by no means essential), the drum could conveniently have 35 holes, different and selected groups of which will be connected to the pressurised interior of the drum depending upon the rotational position of the drum as set by a control knob 90. This knob may be set manually, or by any other convenient input apparatus.

FIG. 10 shows conduits 91 to 95 leading to the first, third, fifth, seventh and ninth units of the top row of units. Similar conduits (not fully shown) will lead to the corresponding units of the second and subsequent rows, making 35 such conduits in all. These selected units thus constitute a sub-group of one of the alternately pressured groups of units already described. Assuming that the letter E is to be written into the apparatus, requiring energization of four units to form the top bar of the letter (corresponding to the four holes shown at the top of the tape in FIG. 8) the drum 89 may be such, when in position to write E, to energize the conduits 91, 92, 93 and 94. Conduit 95 is not required for this letter.

Figure 11:
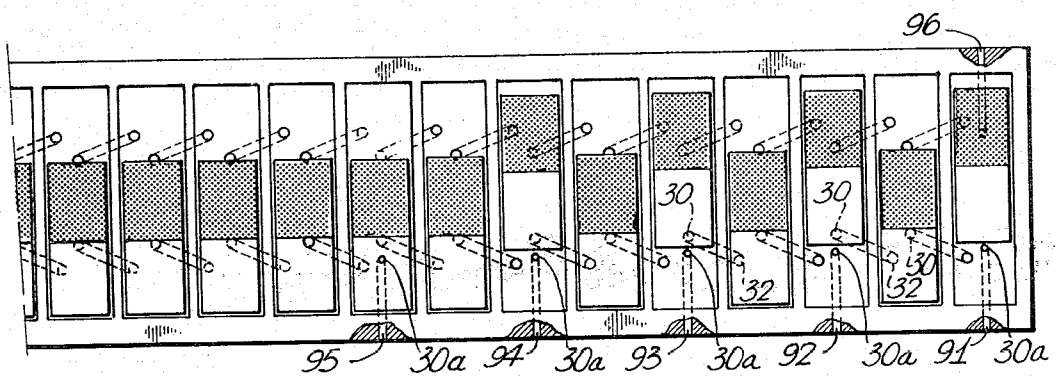
FIG. 11 is a diagrammatic plan view illustrating the operation of the system of FIG. 10.

FIG. 11 demonstrates the manner in which these conduits are connected to the first, third, fifth, seventh and ninth units of the top row of units, and more specifically to auxiliary nozzles 30*a* located adjacent the nozzles 30 for moving the shutters to their open positions similarly to the normal nozzles 30. The first unit has no need for a nozzle 30. FIG. 11 shows the insertion of the four entries needed to start to make the top bar of the letter E. As soon as the valve vane 85 is turned back from its Z position and again oscillated between its X and Y positions, normal progression of the information will take place. On the first such normal cycle the odd-numbered units will become masters, so that the second, fourth, sixth and eighth units are now also moved to the open position, the full eight units forming the top of the bar of the E having been formed. Subsequent alternate pressurisation of the passageways will cause this status to progress along the device. Simultaneously, of course, the appropriate entries will have been made to the other rows of units. For example, only the conduit 94 will have been energized in the second row.

Once the character has begun to progress along the device, it is necessary to reset the first column of units to their closed positions until another character is inserted from the drum 89. This resetting is achieved by energization of a conduit 96 which is permanently connected to the air passage 81 so as to be energized on the second cycle after the units of the first column have served their functions as masters and transmitted their status to the second column.

While the arrangement described employs a transparent (or translucent) shutter having a light transmitting condition when "open" and an opaque or light occluding condition when "closed", there can be substituted for this arrangement one in which the shutter when in its open condition reflects light rather than transmits light through itself. The term "transmit" is thus used to include both this type of through transmission and transmission by reflection. Thus, in a broad sense, the shutter or more generally the "control member" of each display unit (which might for example be a pivoted mirror) requires to have two positions in one of which it acts on a light beam to cause the unit to appear illuminated and in the other dark.

Moreover, the control member may not even act directly on a light beam. Alternatively, it can control a device of the fluidic indicator type, e.g. of a type shown in Canadian patent No. 910,045 issued Sept. 19, 1972 to R. F. O'Keefe or Canadian patent No. 835,118 issued Feb. 24, 1970 to N. C. Sher.

Thus in its broadest aspect the control member is movable between two positions in respective ones of which such member causes the unit to appear in an ON or an OFF condition.

As to the pressures employed in the apparatus illustrated, these are of course intended to be merely relative, rather than necessarily above atmospheric. For example, alternate pressurisation and suction in all even numbered cavities while the odd numbered cavities are connected to atmosphere will achieve essentially the desired result.

While the main use foreseen for the display units herein described is in the form of an array as shown, it should be appreciated that individual units can have utility as separate devices. For example a single unit could be used as part of a display board to indicate a binary type condition, e.g. IN or OUT for an employee or the like.

In the preferred embodiment the shutter or other control member has not been shown as secured against any movement that might result from vibration. If vibration is found to be a problem, means can be provided for holding the control member in one or other of its positions at times other than when it is being moved between them. Such means could, for example, take the form of magnetic devices for holding the control member in either of its two positions, such magnetic devices being weak enough to be overcome by the forces of the air nozzles when movement of the control member is desired. Alternatively, this bi-stable condition of the control member could be achieved by selecting an appropriate geometry for the cavity, or for the control member itself, or both, that requires some lifting of the control member during or prior to movement. For example, instead of the shutter and the bottom of the cavity being flat, as in the example shown, these surfaces may curve slightly upwardly so that the lowest points in the cavity would be at its two ends.

I claim:

1. A display device comprising:

a. an array of a plurality of display units arranged in rows and columns, b. means defining a path for light through each unit, c. each said unit having a movable control member having a light transmitting condition and a light occluding condition for displaying a selected pattern of light by actuation of selected ones of said units to their transmitting condition, d. first energization means interconnecting all the units of alternate columns of units as a first group, e. second energization means interconnecting as a second group all the units of the columns of units intermediate those of the first group, f. means interconnecting each individual unit to the adjacent unit of the same row in a downstream direction for controlling said downstream unit and hence rendering said downstream unit a "slave" unit to the upstream unit which latter thus becomes a "master" unit for reproducing in the slave unit the condition of such upstream master unit, g. first means for actuating said first energization means for simultaneously rendering all units of said first group master units and all units of the second group slave units, h. second means for actuating said second energization means for simultaneously rendering all units of the second group master units and all units of the first group slave units, and i. means for operating said first and second actuating means alternately to cause said pattern to travel along the array.

2. A display device according to claim 1, wherein each unit comprises j. means defining a cavity, k. a shutter slidably movable in said cavity between two positions in an open one of which a light transmitting portion of the shutter is at a predetermined location in said cavity to provide said light transmitting condition and in a closed one of which an opaque portion of said shutter is at said predetermined location to provide said light occluding condition, l. a pair of oppositely directed air nozzles oriented for respectively moving said shutter between its two positions, m. said cavity including a pair of ports for opening and closing by the shutter, the first port being open and the second closed when the shutter is in its open position and the first closed and the second open when the shutter is in its closed position, n. said means (f) interconnecting the units comprising a first passageway interconnecting the first port of each unit with the nozzle of the adjacent downstream unit for moving the shutter of such downstream unit to its open position, and a second passageway interconnecting the second port of each unit with the nozzle of the downstream unit for moving the shutter of such downstream unit to its closed position.

3. A display device according to claim 2 wherein o. said means (g) for actuation of said first energization means comprise a first group of passageways extending along alternate rows of said units, and p. said means (h) for actuation of said second energization means comprise a second group of passageways extending along the rows of units intermediate those of said first group of passageways.

4. A display device according to claim 1, including input means for controlling the condition of the units of the most upstream column of units.

5. A display device according to claim 4, including means for sensing series of holes in a tape, said holes arranged in said selected pattern for controlling said input means.

6. A display device according to claim 4, including means interconnecting said input means with said first actuating means whereby said input means is actuated during actuation of said first group of units.

7. A display device according to claim 1, including input means connected to individual units of a sub-group of said first group, said sub-group comprising a plurality of upstream units of each row representing the largest desired pattern.

8. A unit for use in an illuminated display device comprising a. means defining a cavity with a substantially horizontal bottom surface, b. means defining a path of travel for a light beam through said cavity, c. a control member of flat configuration having light transmitting and blocking portions and located in said cavity to rest on said bottom surface in said path of travel and horizontally movable in said cavity between two positions in respective ones of which said member acts on said light beam to cause the unit to appear illuminated or dark, and d. a pair of oppositely directed air nozzles extending into said cavity and being oriented for directing air flows for acting in opposite directions on said member for respectively moving said member between its two positions, each said air flow being substantially directed between said control member and said bottom surface to form an air cushion therebetween to facilitate such movement.

9. A unit for use in a display device comprising a. means defining a cavity with a substantially horizontal bottom surface, b. a control member of flat configuration disposed in said cavity to rest on said bottom surface and be movable thereon from a first position near one side of the cavity to a second position near the other side of said cavity, c. first means connected to said one of said sides for providing a first air flow, substantially between said horizontal bottom surface and said control member for forming an air cushion between said surface and said member and moving said control member to said second position, and d. second means connected to said other side for providing a second air flow, substantially between said horizontal bottom surface and said control member for forming an air cushion between said surface and said member and moving said control member to said first position, e. in which said horizontal bottom surface and one opposite side of said means defining a cavity contains sections which allow passage of light, and f. wherein said control member is a shutter, allowing passage of light in one of said first and second positions and obstructing passage of light in the other of said first and second positions.

10. A unit according to claim 9 in which at least one section of said means defining a cavity is made from a transparent material.

11. A unit according to claim 9 wherein said shutter has two different portions, one portion allowing transmission of light, the other occluding light.

12. A unit according to claim 9 further comprising at least one pressurization passage extending into said means defining a cavity, and means for pressurizing said cavity through said passage.

13. A unit according to claim 12, further comprising means for sensing the position of said control member.

14. A unit according to claim 13 wherein said means for sensing comprise two sensing ports, a first of which is closed when said control member is in said first position, and the second of which is closed when said control member is in said second position.

15. In a display device, a sequence of units each comprising a. means defining a cavity with a substantially horizontal bottom surface, b. a control member disposed in said cavity to rest on said bottom surface and be movable thereon from a first position near one side of the cavity to a second position near the other side of said cavity, c. first means connected to said one of said sides for providing a first air flow, substantially between said horizontal bottom surface and said control member for forming an air cushion between said surface and said member and moving said control member to said second position, d. second means connected to said other side for providing a second air flow, substantially between said horizontal bottom surface and said control member for forming an air cushion between said surface and said member and moving said control member to said first position, e. at least one pressurization passage extending into said means defining a cavity, and means for pressurizing said cavity through said passage, and f. means for sensing the position of said control member, g. said means for sensing comprise two sensing ports, a first of which is closed when said control member is in said first position, and the second of which is closed when said control member is in said second position;

in which for each unit said first and second means for providing air flows include oppositely directed first and second air nozzles within said means defining the cavity of said unit, passages connecting said air nozzles to the sensing ports of a preceding unit and means for applying a pressure in the preceding unit higher than that in said unit, whereby to energise said first air nozzle when the control member in said preceding unit is in said second position and to energise said second air nozzle when the control member in said preceding unit is in said first position.

16. A sequence of units according to claim 15, including first passageway means connecting said pressurization passages to a first group of alternate units.

17. A sequence of units according to claim 16, including second passageway means connecting said pressurization passages to a second group of units intermediate those of the first groups of alternate units.

18. A sequence of units according to claim 17 including means for pressurizing said first and second passageways alternately.

* * * * *